US006587648B1

(12) United States Patent
Taniyama

(10) Patent No.: US 6,587,648 B1
(45) Date of Patent: Jul. 1, 2003

(54) DEVELOPER SUPPLY DEVICE

(75) Inventor: Yoshiharu Taniyama, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/998,414

(22) Filed: Dec. 3, 2001

(30) Foreign Application Priority Data

Dec. 6, 2000 (JP) ..... 2000-371897

(51) Int. Cl.[7] ..... G03G 15/00
(52) U.S. Cl. ..... 399/12; 399/262
(58) Field of Search ..... 222/DIG. 1; 399/12, 399/24, 25, 27, 258, 262

(56) References Cited

U.S. PATENT DOCUMENTS 6,240,262 B1 * 5/2001 Taniyama et al. ..... 399/12

* cited by examiner

*Primary Examiner*—Hoang Ngo
(74) *Attorney, Agent, or Firm*—Foley & Lardner

(57) ABSTRACT

The developer supply device includes a loading unit for loading a supply container for storing a developer for supply, a detection mechanism for detecting whether there is a projection for displaying that the developer is a regular product on the outer peripheral surface of the supply container loaded in the loading unit or not, and a driving mechanism for rotating the loaded supply container and supplying the developer to the device to be supplied on the basis of detection of the projection by the detector. The detection mechanism includes a detecting element for detecting the existence of the projection by making contact with the projection of the rotating developer supply container, a contactor for making contact with the outer peripheral surface of the supply container, a mounting member for mounting the contactor and detecting element, and a pressing member for elastically pressing the mounting member, thereby allowing the contactor to make elastically contact with the outer peripheral surface of the developer supply container, and forming a fixed interval between the outer peripheral surface of the developer supply container and the detecting element.

12 Claims, 4 Drawing Sheets

DEVELOPER SUPPLY DEVICE

CROSS-REFERENCE TO RELATED APPLICATION

This application is based upon and claims the benefit of priority from the prior Japanese Patent Application No. 2000-371897, filed on Dec. 6, 2000; the entire contents of which are incorporated herein by reference.

BACKGROUND OF THE INVENTION

1. Field of the Invention

The present invention relates to, for example, a developer supply device for loading a developer supply container for storing a developer for supply in the main unit of an image forming device and supplying the developer to a developing device.

2. Description of the Related Art

An image forming device such as a copying machine, facsimile, or printer has a developing device and toner as a developer to be supplied to the developing device is an important component for enhancing the image quality. Each manufacturer supplies toner most suited to the design specification of his own device to users as its own product (hereinafter, referred to as a regular product).

On the other hand, in recent years, toner satisfying the lowest limit specification which can be used commonly by image forming devices of a plurality of manufacturers is in circulation.

However, the aforementioned toner satisfying the lowest limit specification (hereinafter, referred to as non-regular toner) is generally inferior in image quality and moreover adversely affects the photosensitive drum which is an image carrying member and the developing device and may impair the reliability of the device.

Toner is generally stored in containers and supplied to users. However, containers have been conventionally improved for the purpose of enhancing the operability of users, though little improvement has been made for recommendation of use of a regular product of toner.

SUMMARY OF THE INVENTION

An object of the present invention is to provide a developer supply device capable of performing a supply operation of a developer only when a supply container storing a regular product of developer is loaded and furthermore a developer supply device capable of improving the detection precision on whether the loaded supply container stores a regular product of developer or not.

According to the embodiment of the present invention, a developer supply device is provided, the developer supply device comprises: a loading unit configured to load a supply container containing a developer for supply; a detection mechanism configured to detect whether there is a projection to display that the developer is a regular product on an outer peripheral surface of the supply container loaded in the loading unit or not; and a driving mechanism configured to rotate the loaded supply container and supply the developer to a device to be supplied on the basis of detection of the projection by the detection mechanism; wherein the detection mechanism including: a detecting element to detect existence of the projection by making contact with the projection of the rotating developer supply container; a contactor to make contact with the outer peripheral surface of the supply container; a mounting member to mount the contactor and the detecting element; and a pressing member to elastically press the mounting member to allow the contactor to elastically make contact with the outer peripheral surface of the developer supply container, and form a fixed interval between the outer peripheral surface of the developer supply container and the detecting element.

DETAILED DESCRIPTION OF THE INVENTION

Figure 1:
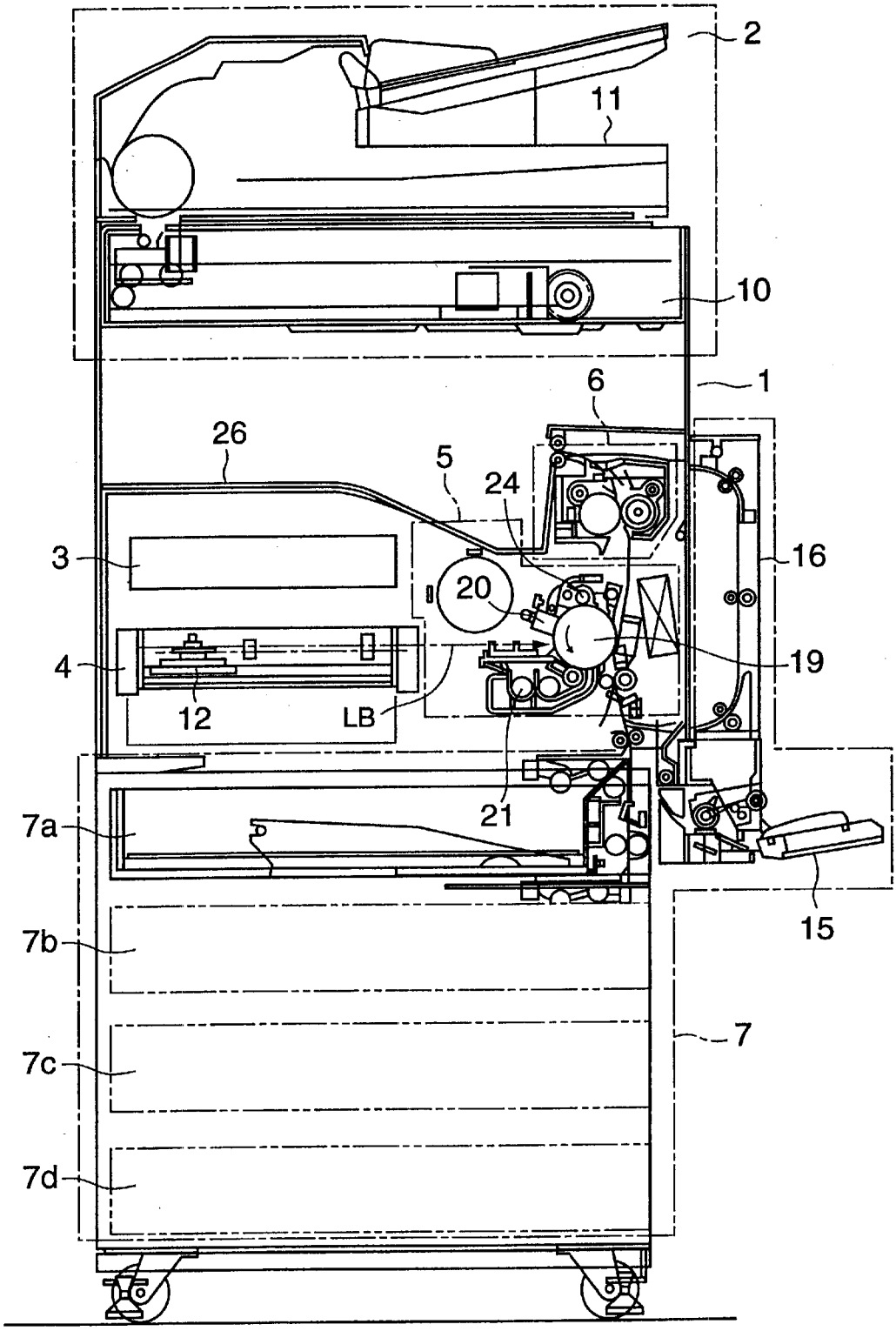
FIG. 1 is a cross sectional view schematically showing a copying machine which is an image forming device in which a developer supply device according to an embodiment of the present invention is loaded.

The present invention will be explained in detail hereunder by referring to an embodiment shown in the drawings.

FIG. 1 is a schematic block diagram showing a digital type copying machine.

The copying machine converts image information obtained by an optical means to image data once, generates a laser beam on the basis of the image data, and exposes and scans a photosensitive drum.

On the upper side of a main body 1, an image reading unit 2 is installed. Almost in the center in the main body 1, an image data storing unit 3, a laser unit 4, an image forming unit 5, and a fixing device 6 are arranged. On the lower side in the main body 1, a paper supply portion 7 is arranged.

The image reading unit 2 has a scanner 10 and an automatic document feeder 11. The scanner 10 reads an image of a document and converts the image to image data. The automatic document feeder 11 sends a sheet document to the scanner 10.

The image data storing unit 3 stores image data supplied from the scanner 10. The laser unit 4 has a plurality of semiconductor laser oscillators (not shown in the drawing) and a polygonal mirror 12. The laser unit 4 takes out image data from the image data storing unit 3, allows the semiconductor laser oscillators to emit light, and scans a laser beam LB on the image forming unit 5 by reflection by the polygonal mirror 12.

The paper supply portion 7 has a plurality of steps of paper supply units 7*a* to 7*d*, a manual paper supply tray 15, and a duplex unit 16. The paper supply units 7*a* to 7*d* are installed on the lower part of the device and in the paper supply units 7*a* to 7*d*, many sheets onto which images are transferred are stored. As sheets, ordinary papers are generally used, though trace papers or OHP films may be used.

The manual paper supply tray 15 is installed on the right side surface of the main body 1 in the neighborhood of the image forming unit 5 and by the manual paper supply tray 15, thick papers such as sheets in size off the JIS standard and postal cards can be supplied manually.

The duplex unit 16 is installed on the right side surface and copies both sides of front and back of each sheet, so that a sheet which passes the image forming unit 5 once and is transferred with an image on its one side is turned over and supplied to the image forming unit 5 again.

Figure 2:
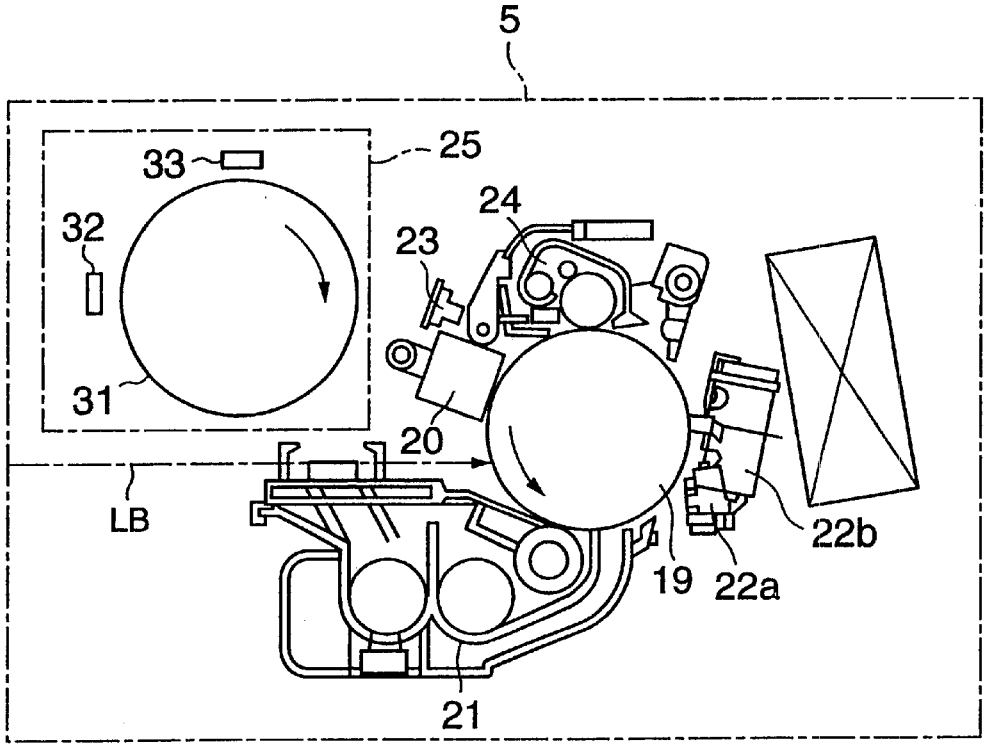
FIG. 2 is a cross sectional view showing an enlarged image forming unit of the copying machine shown in FIG. 1.

FIG. 2 is a front view showing the image forming unit 5 which is enlarged.

The image forming unit 5 has a photosensitive drum 19 rotating in the direction of the arrow and around the photosensitive drum 19, a main charger 20, a developing device 21, a transferring charger 22*a*, a separation charger 22*b*, a drum cleaner 24, and a charge elimination lamp 23 are arranged along the rotational direction thereof. A toner supply device 25 as a developer supply device is attached on the upper side of the developing device 21.

The image forming unit 5 adopts a reversal development system, and the main charger 20 gives a charge of negative polarity to the surface of the photosensitive drum 19, and the laser beam LB irradiated from the laser unit 4 exposes the photosensitive drum 19. In the area corresponding to the image part of the document, the surface potential of the photosensitive drum 19 approaches 0 according to the density of the image by this exposure and an electrostatic image is formed.

In the developing device 21, a carrier and toner constituting the developer are stored and toner is supplied at a rate of about 5% to a carrier of about 95%. The toner amount is always monitored by a magnetic sensor not shown in the drawing, and when the toner rate in the developing device 21 is reduced below 5%, a toner supply unit 28 as a loading unit, which will be described later, of the toner supply device 25 operates, and a necessary amount of toner is supplied.

The carrier and toner are stirred in the developing device 21 and a charge of negative polarity is given to the toner by frictional charging during stirring.

When the latent image is sent to the upper part of the developing device 21 by rotation of the photosensitive drum 19, toner is adsorbed by the photosensitive drum 19 via the carrier and a visible image is formed. The visible image is transferred to a sheet supplied from the paper supply portion 7 by the transferring charger 22*a*. The sheet is given a charge of positive polarity beforehand. The image-transferred sheet is eliminated the positive charge by the separation charger 22*b* immediately after transfer and transported to the fixing device 6. The fixing device 6 fuses toner to the sheet by thermal press and ejects the sheet to a paper receiving tray 26.

The toner remaining on the surface of the photosensitive drum 19 without being transferred to the sheet is removed from the sheet by a drum cleaner 24 together with attached paper powder and the residual electric charge on the photosensitive drum 19 is eliminated by the charge elimination lamp 23.

The toner supply device 25 has a toner cartridge 31 in almost a cylindrical shape as a supply container, an optical sensor 32, and a cleaning unit 33.

The toner cartridge 31, as described later, is driven by a rotation driving unit 35 and rotated in the direction of the arrow, thereby ejects toner from a toner supply port (shown in FIG. 3) 36 installed at the end (the part on the innermost side viewed from the front of the device), and supplies it in the developing device 21.

Figure 3:
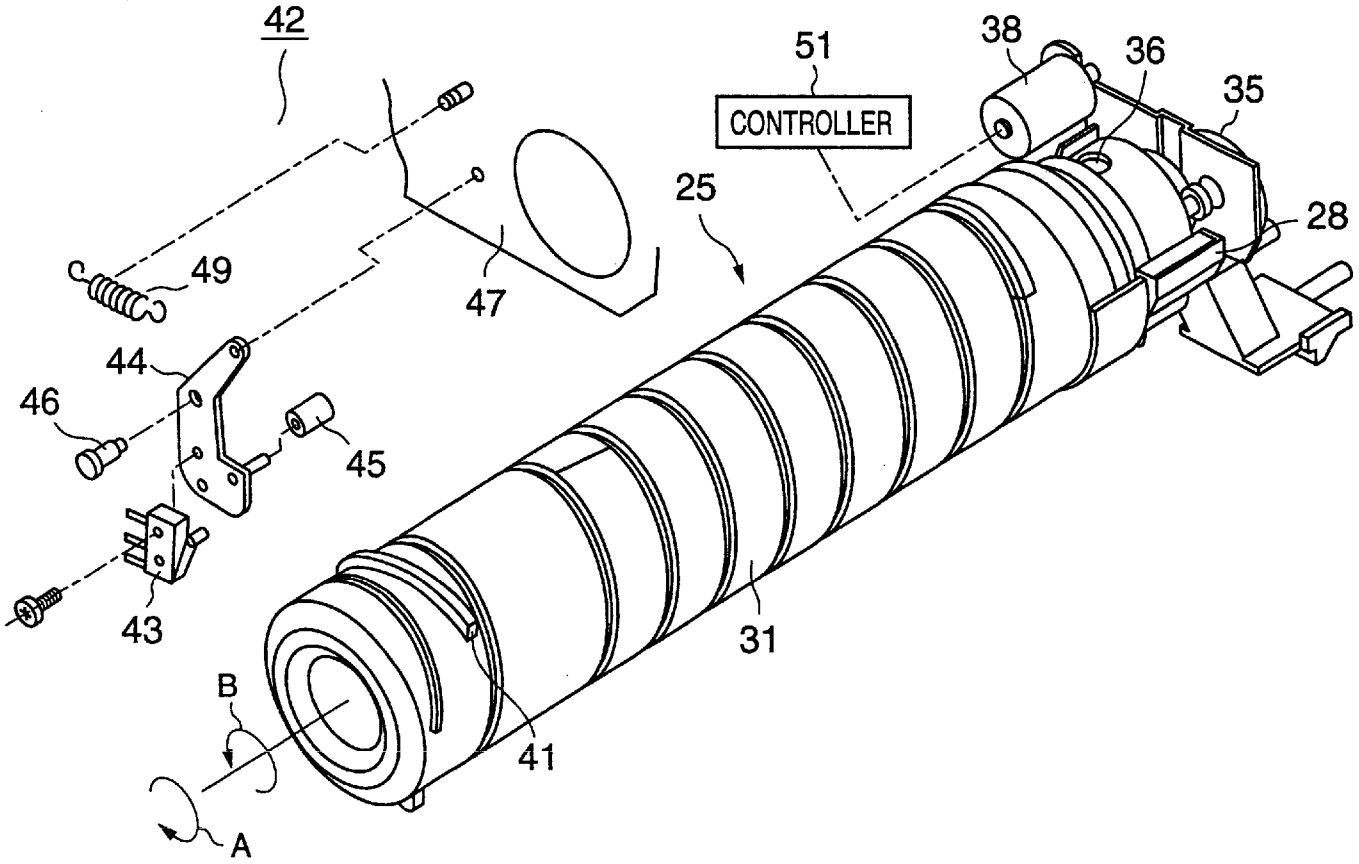
FIG. 3 is a perspective view showing a toner supply device of a developer supply device showing an embodiment of the present invention.

FIG. 3 shows the condition that the toner cartridge 31 is inserted along a guide not shown in the drawing and loaded in the toner supply unit 28 in the toner supply device 25.

The toner cartridge 31, as mentioned above, has an almost cylindrical shape and the toner supply port 36 is installed on the peripheral surface of the end thereof. The end is pressed when the toner cartridge 31 is loaded, thereby connected to the toner supply unit 28.

The toner supply unit 28 is connected to the rotation driving unit 35 including a driving motor 38. The explanation of detailed constitution is omitted. The rotation driving unit 35 rotates the toner cartridge 31 in the counterclockwise direction B or the clockwise direction A upon receipt of a command from a controller 51. By the rotation operation of the toner cartridge 31, the toner stored in the toner cartridge 16 is stirred.

The toner cartridge 31 is cylindrical and the diameter of the section is, for example, 70 mm. On the inner peripheral surface of the toner cartridge 31, a spiral projection (not shown in the drawing) is formed almost overall the length direction thereof. When the toner cartridge 31 is rotated in the clockwise direction A by the rotation driving unit 35 via the toner supply unit 28, toner is moved toward the toner supply port 36 at the end by being stirred by the spiral projection formed.

During use of a copying machine, when the toner in the toner cartridge 31 is all supplied to the developing device 21 and furthermore, the toner amount in the developing device 21 is reduced below the specified value (5% in this embodiment), an indication of "Toner Empty" appears on a control panel, not shown in the drawing, of the copying machine, urging a user to exchange the toner cartridge 31.

The user seeing the indication of "Toner Empty" prepares a new toner cartridge 31 and performs an exchange operation.

When the exchange operation is to be performed, firstly, the user opens a front cover (not shown in the drawing), which can be opened or closed, installed on the front of the image forming unit 5 and takes out the empty toner cartridge 31. Then, he loads a new toner cartridge 31 in the toner supply device 25 and closes the front cover.

Figure 4:
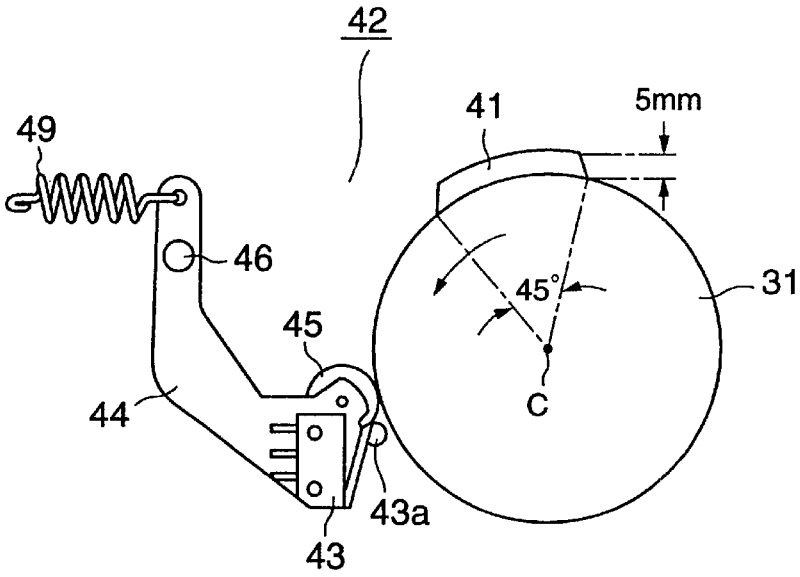
FIG. 4 is a front view showing a supply container and detecting device of the toner supply device shown in FIG. 3.
Figure 5:
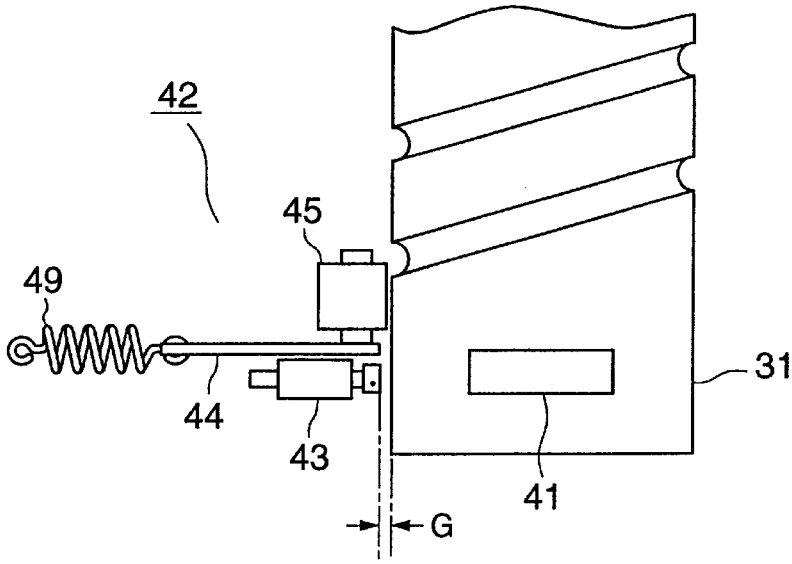
FIG. 5 is a plan view showing a supply container and detecting device of the toner supply device shown in FIG. 3.

FIG. 4 is a front view showing the detecting device for detecting whether the toner stored in the toner cartridge 31 is a regular product or not and FIG. 5 is a plan view thereof. FIG. 3 shows the disassembly condition of the detecting device 42.

The detecting device 42 is installed on the opposite side of the insertion end.

On the outer peripheral surface of the toner cartridge 31 to be loaded on the opposite side of the insertion end, the rib-shaped projection 41 is formed along the peripheral direction thereof. In the toner cartridge 31 with the projection 41 formed, toner of a regular product is stored. As shown in FIG. 4, the height of the projection 41 is, for example, 5 mm and the length thereof forms an angle of 45° for the center position of the toner cartridge 31. The length corresponds to the time interval required for the toner cartridge 31 to rotate and detect the existence of the projection 41. Therefore, the time interval of detection specified by the rotational speed of the toner cartridge and the length of the projection 41 indicates that the stored toner is a regular product.

The detecting device 42 has a detector 43 as a detecting element and the detector 43 is attached to one end of a bracket 44 as a mounting member. Further, to one end of the bracket 44, a roller 45 as a contactor is attached so as to be freely rotated. The bracket 44 is attached to a frame (shown in FIG. 3) 47 via a shaft 46 so as to freely swing.

To the other end of the bracket 44, a spring 49 as a pressing member is connected and by the pressing force of the spring 49, the bracket 44 is pressed so as to rotate round the shaft 46 in the counterclockwise direction. By the pressing, the roller 45 is always in contact with the outer peripheral surface of the toner cartridge 31 and between an actuator 43*a* of the detector 43 and the outer peripheral surface of the toner cartridge 31, a fixed interval G is formed.

As mentioned above, when a new toner cartridge 31 is loaded, prior to the toner supply operation, whether the toner in the loaded toner cartridge 31 is a regular product or not is detected by the detecting device 42.

Namely, in this case, by the rotation driving unit 35 of the toner supply unit 28, the toner cartridge 31 rotates two times or more in the counterclockwise direction (the direction of the arrow B), that is, in the opposite direction of the rotational direction (the direction of the arrow A) when toner is to be supplied. By this rotation, the existence of the projection 41 of the toner cartridge 31 is detected by the detector 43. Namely, when the projection 41 is available, the end of the actuator 43*a* of the detector 43 is pressed and operated by the projection 41 due to rotation of the toner cartridge 31 and the device enters a switch on state. When the time interval of the switch-on state is equal to a predetermined interval, it is discriminated by the controller 51 that the toner cartridge 31 stores toner of a regular product and the supply operation is started. Namely, that the time interval of detection specified by the rotational speed of the toner cartridge and the length of the projection 41 is a predetermined time interval indicates that the stored toner is a regular product.

Further, when the loaded toner cartridge 31 has not the projection 41, the detector 43 is kept off, and even if a projection is provided, when the projection is different from a desired specification, even if the detector 43 is turned on, it is discriminated by the controller 51 that the toner stored in the loaded toner cartridge 31 is not a regular product, and the toner supply operation is stopped.

Further, when it is discriminated by the controller 51 that the toner in the toner cartridge 31 is not a regular product, the result may be displayed on the control panel so as to transfer it to a user or the result may be pulled out only by a service man in charge by inputting a predetermined service code.

Further, when the operation condition of a copying machine can be remote controlled using a communication line, information of judgment results may be transferred to a control computer of a service center and notified to a serviceman in charge, an agency in charge of users, and a salesman in charge.

When the toner stored in the toner cartridge 31 is discriminated to be a regular product like this, prior to supply of toner to the developing device 21, the toner supply device 25 stirs the toner in the toner cartridge 31. Namely, by the rotation driving unit 35, the toner cartridge 31 is rotated round the projection 41 alternately in the clockwise direction (the direction of the arrow A) and counterclockwise direction (the direction of the arrow B) respectively at a predetermined angle.

When the toner is set in the toner cartridge 31 depending on the retention period and retention condition by this rotation of the toner cartridge 31, the lump can be destroyed, so that the subsequent toner supply amount can be stabilized. By doing this, the stirring operation of toner in the toner cartridge 31 which is conventionally performed by a user before loading is not necessary and the operation burden imposed on him can be relieved.

As mentioned above, according to this embodiment, the projection 41 for displaying that toner is a regular product is installed on the outer peripheral surface of the toner cartridge 31 for storing toner for supply, so that the toner cartridge 31 for storing a developer of a regular product can be discriminated visually even before loading.

Further, the equipment has the detecting device 42 for detecting the projection 41 of the toner cartridge 31 loaded in the toner supply unit 28 and toner can be supplied only when the detector 43 thereof detects the projection 41, so that only toner of a regular product can be supplied surely.

Furthermore, the detecting device 42 has the roller 45 in contact with the outer peripheral surface of the toner cartridge 31 and by the contact with the roller 45, a fixed interval G is formed between the actuator 43*a* of the detector 43 and the outer peripheral surface of the toner cartridge 31, so that even if the outer diameter of the toner cartridge 31 is varied, the actuator 43*a* can make surely contact with the projection of the toner cartridge 31 and precise and stable detection can be always executed. As described above, the present invention installs a projection for displaying that a developer is a regular product on the outer peripheral surface of a supply container for storing a developer for supply, so that the supply container for storing a developer of a regular product can be visually discriminated even before loading.

Further, the present invention has a detecting means for detecting the projection for display of the supply container loaded in the loading unit and can supply only a developer of a regular product surely because a developer can be supplied only when the detecting means detects the projection.

Further, the detecting means has a contactor in contact with the outer peripheral surface of the supply container and a fixed interval is formed between the detecting element and the outer peripheral surface of the supply container by contact with the contactor, so that even if the outer diameter of the supply container is varied, the detecting means can make surely contact with the projection of the supply container and precise and stable detection can be always executed.

What is claimed is:

1. A developer supply device comprising:

a loading unit configured to load a supply container containing a developer for supply;

a detection mechanism configured to detect whether there is a projection to display that the developer is a regular product on an outer peripheral surface of the supply container loaded in the loading unit or not; and a driving mechanism configured to rotate the loaded supply container and supply the developer to a device to be supplied on the basis of detection of the projection by the detection mechanism;

wherein the detection mechanism including:

a detecting element to detect existence of the projection by making contact with the projection of the rotating developer supply container;

a contactor to make constant contact with the outer peripheral surface of the supply container when the supply container is loaded in the loading unit;

a mounting member to mount the contactor and the detecting element; and a pressing member to elastically press the mounting member to allow the contactor to elastically make contact with the outer peripheral surface of the developer supply container, and form a fixed interval between the outer peripheral surface of the developer supply container and the detecting element.

2. The developer supply device according to claim 1, wherein the device to be supplied is a developing device.

3. The developer supply device according to claim 1, wherein a spiral-shaped projection is formed in the developer supply container almost overall a full-length in a length direction of the container.

4. The developer supply device according to claim 3, wherein the developer supply container is rotated in a first direction when the existence of the projection is to be detected by the detecting element and rotated in a second direction opposite to the first direction when the developer is to be supplied to the device to be supplied.

5. The developer supply device according to claim 3, wherein the developer supply container stirs the developer alternately rotated in a first direction and in a second direction opposite to the first direction.

6. The developer supply device according to claim 1, wherein the projection is formed in a projection state along a rotational direction of the supply container.

7. The developer supply device according to claim 6, wherein the projection in a projection state has a sufficient length to make contact continuously with the detecting element during a predetermined time interval of rotating of the developer supply container.

8. The developer supply device according to claim 6, wherein during rotation in a first direction two times or more, the developer supply container detects the existence of the projection by the detecting element.

9. The developer supply device according to claim 1, wherein the detecting element comprises:

a rotating element that is positioned with respect to the developer supply container such that the rotating element only makes contact with the projection of the developer supply container when the developer supply container is rotated.

10. The developer supply device according to claim 9, wherein the detecting element further comprises:

a detecting device configured to detect a presence of the projection when the projection is positioned in front on the detecting device, wherein the detecting device is turned on to perform a detecting function only when the rotating element is in contact with the projection.

11. A developer supply device comprising:

a loading unit configured to load a supply container containing a developer for supply;

a detection mechanism configured to detect whether there is a projection to display that the developer is a regular product on an outer peripheral surface of the supply container loaded in the loading unit or not; and a driving mechanism configured to rotate the loaded supply container and supply the developer to a device to be supplied on the basis of detection of the projection by the detection mechanism;

wherein the detection mechanism including:

a detecting element to detect existence of the projection by making contact with the projection of the rotating developer supply container;

a contactor to make contact with the outer peripheral surface of the supply container;

a mounting member to mount the contactor and the detecting element; and a pressing member to elastically press the mounting member to allow the contactor to elastically make contact with the outer peripheral surface of the developer supply container, and form a fixed interval between the outer peripheral surface of the developer supply container and the detecting element, wherein the contactor is attached to the mounting member so as to freely rotate and rotates in correspondence to rotation of the supply container.

12. A developer supply device comprising:

a loading unit configured to load a supply container containing a developer for supply;

a detection mechanism configured to detect whether there is a projection to display that the developer is a regular product on an outer peripheral surface of the supply container loaded in the loading unit or not; and a driving mechanism configured to rotate the loaded supply container and supply the developer to a device to be supplied on the basis of detection of the projection by the detection mechanism;

wherein the detection mechanism including:

a detecting element to detect existence of the projection by making contact with the projection of the rotating developer supply container;

a contactor to make contact with the outer peripheral surface of the supply container;

a mounting member to mount the contactor and the detecting element; and a pressing member to elastically press the mounting member to allow the contactor to elastically make contact with the outer peripheral surface of the developer supply container, and form a fixed interval between the outer peripheral surface of the developer supply container and the detecting element, wherein the mounting member is installed so as to freely rotate, and the contactor and the detecting element are attached on one side, and another end is pressed by a pressing member.

* * * * *